US006454092B1

(12) United States Patent
Lee

(10) Patent No.: US 6,454,092 B1
(45) Date of Patent: Sep. 24, 2002

(54) TOOL ENGAGING CAVITY OF TOOL BOX

(76) Inventor: Pei Ling Lee, 11 F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/736,465

(22) Filed: Dec. 15, 2000

(51) Int. Cl.[7] ..... B65D 85/20
(52) U.S. Cl. ..... 206/378; 211/70.6
(58) Field of Search ..... 206/372, 373, 206/378; 211/70.6; 312/902

(56) References Cited

U.S. PATENT DOCUMENTS 4,911,083 A * 3/1990 Considine ..... 108/25
6,039,188 A * 3/2000 Lee ..... 206/758
6,098,799 A * 8/2000 Lee ..... 206/350
6,109,437 A * 8/2000 Chao ..... 206/303
6,142,920 A * 11/2000 Ogura ..... 483/59

* cited by examiner

*Primary Examiner*—David T. Fidei
(74) *Attorney, Agent, or Firm*—Charles E. Baxley

(57) ABSTRACT

A tool box includes a display surface in which at least one cavity is defined. Which includes a bottom surface and two opposite insides extend from the bottom surface. The two opposite insides extend inclinedly toward each other and are wave-shaped. A tip portion is formed on an abutment between each inside and the display surface so that the two tip portions are engaged with two ends of a socket.

1 Claim, 4 Drawing Sheets

TOOL ENGAGING CAVITY OF TOOL BOX

FIELD OF THE INVENTION

The present invention relates to a structure of a cavity in a tool box and the cavity having two protrusions for engaging with two open ends of a socket.

BACKGROUND OF THE INVENTION

A conventional tool box 1 generally is made by way of blowing molding and a plurality of cavities 10 as shown in FIG. 1 are defined in the tool box 1. Each cavity 10 has two ribs 11 extending inward from two opposite insides defining the cavity 10 so that a socket 15 is. clamped by the two ribs 11. This conventional structure of the cavity 10 can position the socket 15 because the distance between two ribs 11 is slightly smaller than an outer diameter of the socket 15 so that the socket 15 is forced inserted in the cavity 10. However, because the two ribs 11 contact the smooth and round outer periphery of the socket 15 so that when the tool box 1 receives an impact, the socket 15 will disengaged from the cavity 10 easily. The users have to re-arrange all the sockets 15 in correct cavities 10 one by one. Unfortunately, this happens all the time and the re-arrangement of the sockets 15 takes a lot of time.

The present invention intends to provide a structure of a cavity of tool box and the cavity has two protrusions for respectively engaging with two open ends of a socket.

SUMMARY OF THE INVENTION

In accordance with one aspect of the present invention, there is provided a cavity structure defined in a display surface of a tool box and includes a bottom surface and two opposite insides extend from the bottom surface. The two opposite insides extend inclinedly toward each other and a tip portion is formed on an abutment between each inside and the display surface so that the two tip portions are engaged with two ends of a socket.

The primary object of the present invention is to provide a cavity structure that can position the socket more secure.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
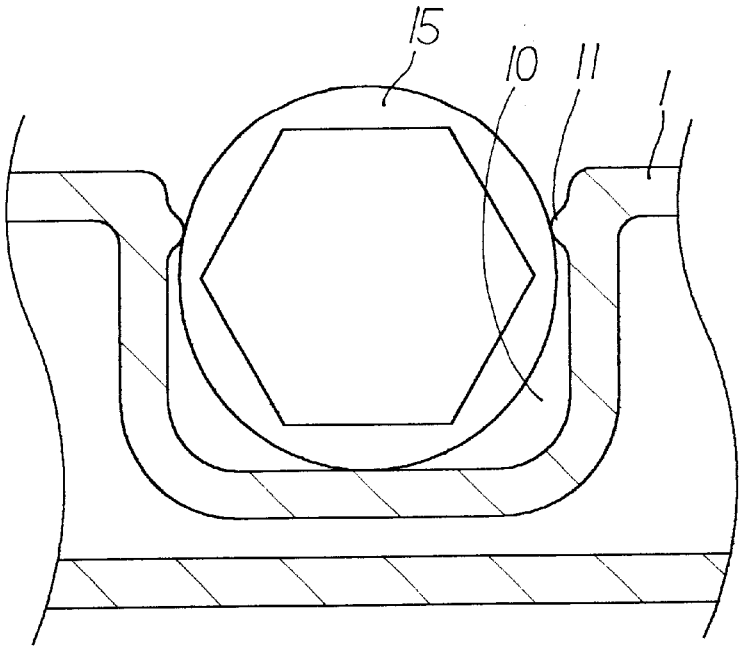
FIG.1 PRIOR ART
FIG. 1 is a cross sectional view to show a conventional cavity structure for engaging a socket there FIG. 2 perspective view to show a tool box having the cavities of the present invention.
Figure 5:
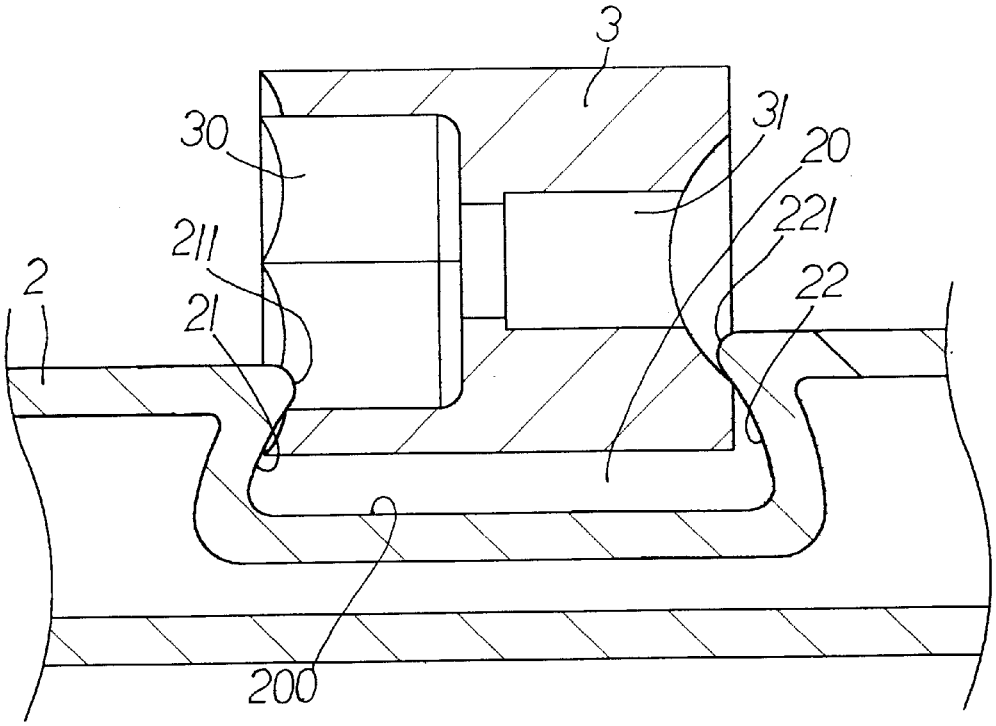
FIG. 5 is a cross sectional view to show another embodiment of the cavity of the present invention and a socket.
Figure 2:
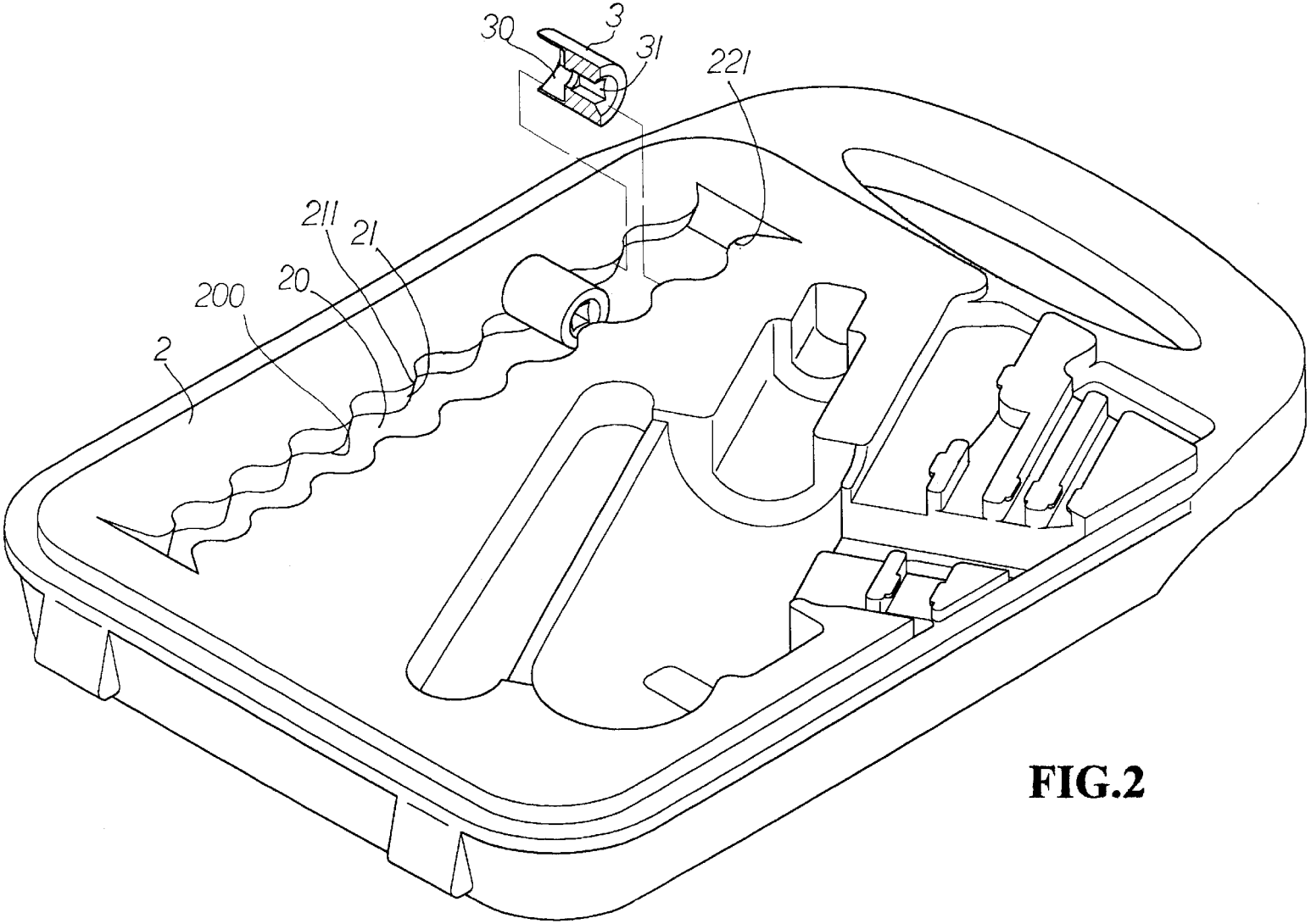
Figure 3:
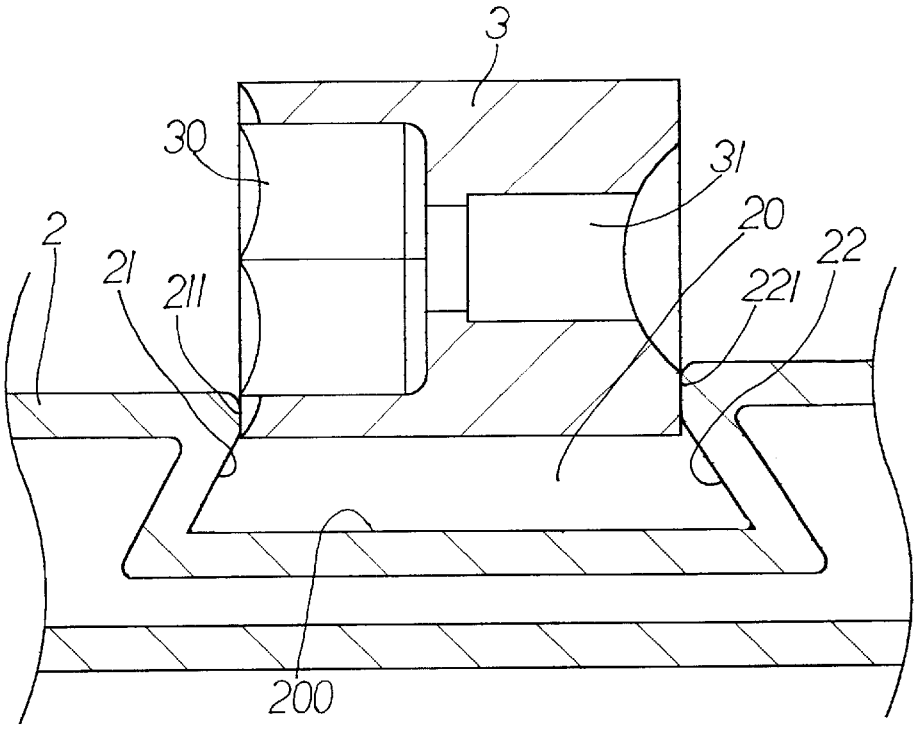
FIG. 3 s a cross sectional view to show when a socket is about to be engaged with the tip portions of the cavity of the present invention.
Figure 4:
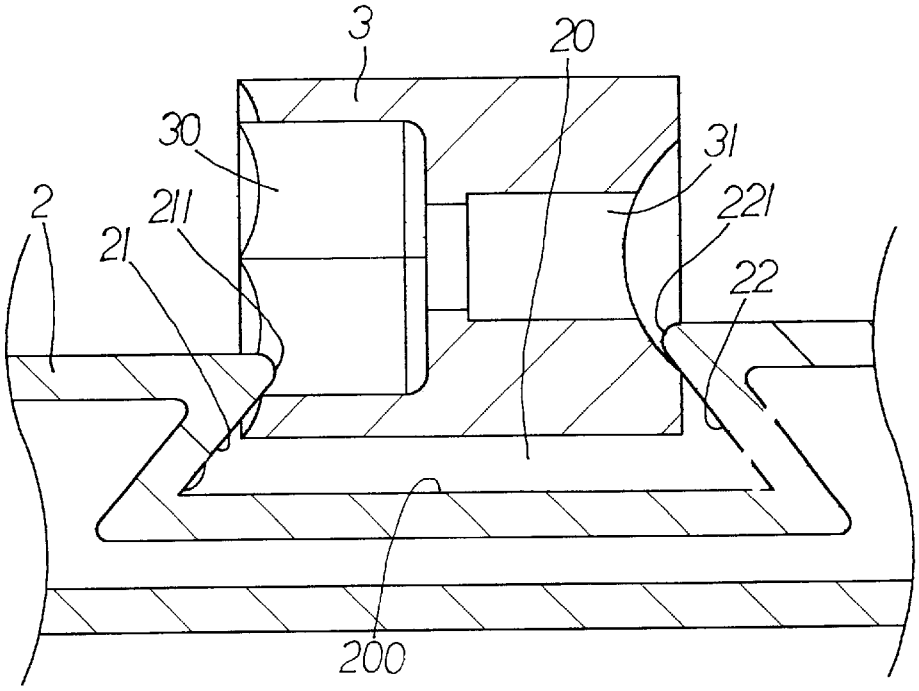
FIG. 4 is a cross sectional view to show the socket is engaged with the two tip portions of the of the present invention.

Referring to FIGS. 2 to 4, the tool box has a display surface 2 and a plurality of cavities 20 defined in the display surface 2 for engaging sockets 3 therein. Each cavity 20 has a bottom surface 200 and two opposite insides 21, 22 extend from the bottom surface 200. The two opposite insides 21, 22 are wave-shaped and extend inclinedly toward each other. It is to be noted that the two opposite insides 21, 22 extend inclinedly toward each other so that a top opening of the cavity 20 is smaller than a base portion of the cavity 20. A tip portion 211/221 is formed on an abutment between each inside 21/22 and the display surface 2 and the two tip portions 211, 221 are engaged with two ends 30, 31 of the socket 3. The two opposite insides 21, 22 are made of plastic material so that they have a certain degree of flexibility which allows the socket 3 be forced to pass between the gap between the two tip portions 211, 221. Because the tip portions 211, 221 are engaged with the two open ends 30, 31 of the socket 3, not the lateral periphery of the socket 3 so that the socket 3 can be positioned securely. The cavities 20 are communicated with each other and the gap between the respective tip portions 211, 221 are varied so as to engage with sockets 3 with different sizes. As shown in FIG. 5, the two opposite insides 21, 22 can made to be a recessed and curved surface.

Figure 6:
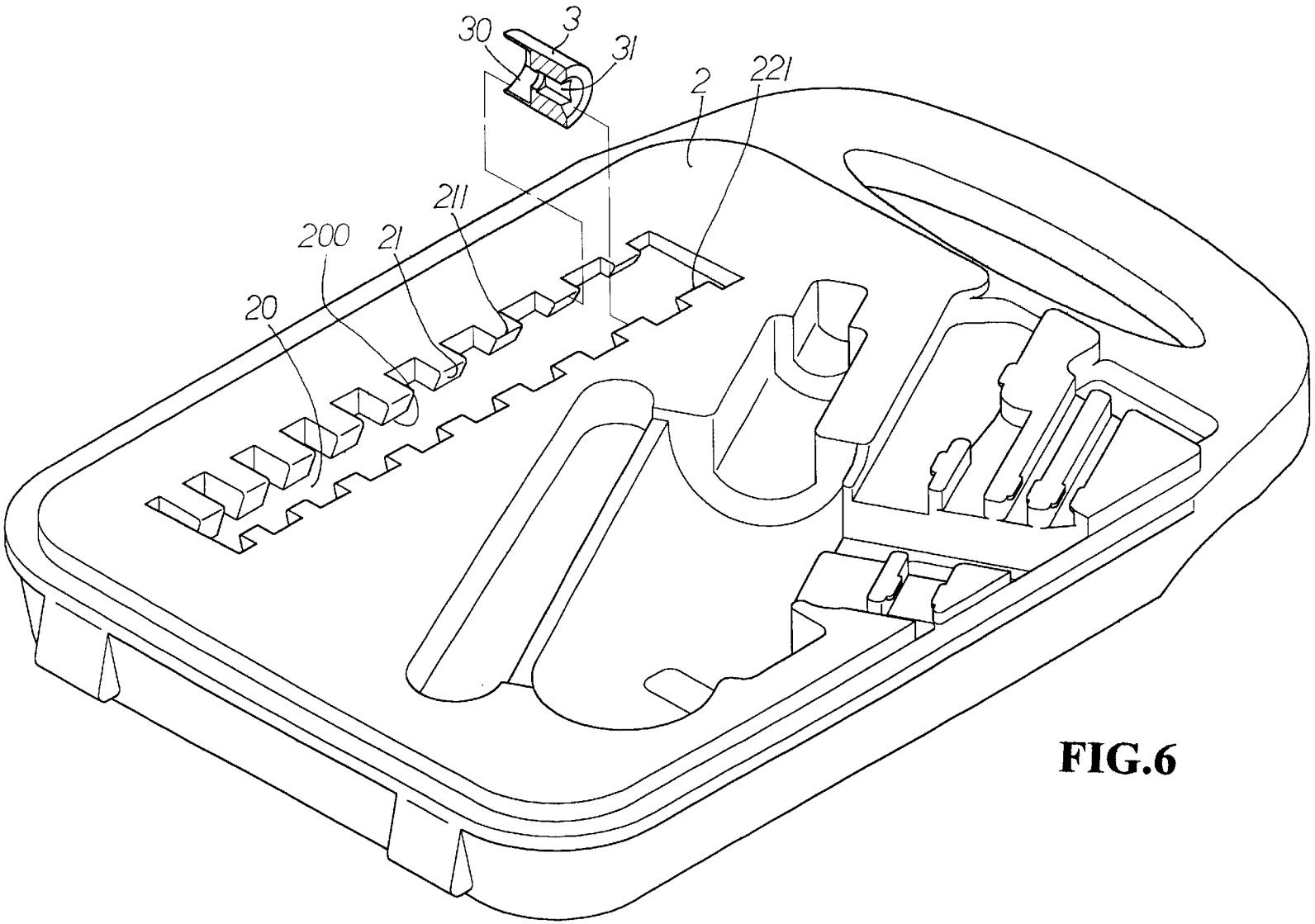
FIG. 6 is a perspective view to show yet another embodiment of the cavities of the present invention.

FIG. 6 shows that the tip portion 211/221 extends perpendicularly from each of the two opposite insides 21, 22 and each tip portion 211/221 has a rectangular cross section.

While we have shown and described various embodiments in accordance with the present invention, it should be clear to those skilled in the art that further embodiments may be made without departing from the scope and spirit of the present invention.

What is claimed is:

1. A tool box, comprising:

a display surface and an elongated groove defined in the display surface, the groove being defined by a bottom surface and two opposite walls which extend inclinedly from the bottom surface and toward each other, a plurality of protrusions extending from the two opposite walls and being in flush with the display surface, a distance between the two opposite protrusions being smaller than a distance between the two opposite walls of the groove.

* * * * *